United States Patent [19]

Cartier

[11] Patent Number: 5,063,910

[45] Date of Patent: Nov. 12, 1991

[54] APPARATUS FOR TREATING VASCULAR, METABOLIC AND FUNCTIONAL IMBALANCE AND EDEMA OF A HUMAN LIMB

[76] Inventor: Claude-Julien Cartier, 11, rue Bourdillon, F-36000 Chateauroux, France

[21] Appl. No.: 437,303

[22] Filed: Nov. 16, 1989

[30] Foreign Application Priority Data

Nov. 18, 1988 [FR] France ..... 88 14987

[51] Int. Cl.[5] ..... A61H 9/00

[52] U.S. Cl. ..... 128/24 R; 128/65; 128/402

[58] Field of Search ..... 128/24 R, 38, 39, 40, 128/64, 140, 402, 65, 66, 400; 272/130

[56] References Cited

U.S. PATENT DOCUMENTS

| | | | |
|---|---|---|---|
| 3,292,613 | 12/1966 | Mac Leod | 128/40 |
| 3,997,396 | 8/1976 | Cartier | 128/65 |
| 4,149,529 | 4/1979 | Copeland et al. | 128/400 X |
| 4,408,599 | 10/1983 | Mummert | 128/24 R |
| 4,648,392 | 3/1987 | Cartier et al. | 128/402 X |

FOREIGN PATENT DOCUMENTS

| | | | |
|---|---|---|---|
| 0305284 | 3/1989 | European Pat. Off. . | |
| 2516443 | 4/1975 | France | 128/24 R |
| 2267747 | 11/1975 | France . | |

*Primary Examiner*—Richard J. Apley
*Assistant Examiner*—L. Thomas
*Attorney, Agent, or Firm*—Young & Thompson

[57] ABSTRACT

In an apparatus for treating vascular, metabolic and functional imbalance, and edema of a limb by variation in pressure of a high-density fluid around the limb, a fluid-tight flexible bag serves to protect the limb to be treated and a filling bag delimits a filling enclosure with the protective bag. The apparatus includes a pump for producing upward and downward displacement of the fluid within the enclosure between a bottom level, a top level and intermediate levels, a timing circuit for maintaining the fluid at predetermined levels during predetermined periods of time, and a programmable logic circuit for adjusting the levels of fluid within the enclosure. An electronic variator are employed for regulating the speeds of upward and/or downward displacement of the fluid within the enclosure in respect of different levels.

11 Claims, 3 Drawing Sheets

APPARATUS FOR TREATING VASCULAR, METABOLIC AND FUNCTIONAL IMBALANCE AND EDEMA OF A HUMAN LIMB

BACKGROUND OF THE INVENTION

1. Field of the invention

The present invention relates to an apparatus for treating vascular, metabolic and functional imbalance of a limb by variations in pressure of a high-density fluid around said limb.

This invention is more particularly applicable to the treatment of vascular, metabolic and functional imbalance and edema of lower and/or upper limbs by external compression and decompression of one or more limbs of a patient, by virtue of the action of a high-density liquid such as mercury.

2. Description of the Prior Art

Particularly as disclosed in French patent No. 2,267,747, it is known to treat an edema of an upper or lower limb by producing pressure variations of a high-density liquid such as mercury around the limb. The apparatus described in the patent cited above makes it possible to subject the limb to be treated to a pressure which progressively increases towards the end of the limb and which is exerted at right angles to the surface of the skin. In order to obtain this pressure variation, there is provided in the known apparatus a fluid-tight bag into which the limb to be treated is introduced, said bag being surrounded by an enclosure within which mercury is caused to rise progressively from a bottom level represented by the bottom of the enclosure and corresponding to the end of the limb to be treated to a top level represented by the upper portion of the enclosure. The top level is adjacent to the root of the limb to be treated. The top and bottom levels are indicated visually. The rise of mercury within the enclosure is produced by pneumatic means (compressed gas) which displace the mercury and ensure that this latter progressively rises within the enclosure at a low and constant rate. When the mercury has reached the top level, the operator can maintain this level during a period of time which he chooses as a function of the treatment to be carried out, whereupon he opens a valve which enables the mercury to fall back into the enclosure simply under the action of gravity, at a fairly low and constant rate. These operations can then be repeated in the same manner. All these operations are controlled by hand.

The apparatus described in the patent cited earlier makes it possible to obtain spectacular reductions of edema, in particular lymphatic edema. However, recent studies made by the inventor show that, depending on the pathology to be treated, even more spectacular results can be obtained by respecting successive mercury-level stages within the enclosure during the rise and/or fall of the mercury. These results are improved even further by modifying the rate of rise and/or fall of mercury within the enclosure. These studies have also shown that the results obtained depend on the length of time during which the mercury is maintained at the top and/or bottom level within the tank and on the lengths of time during which it is maintained at intermediate levels during different sequences of the same compressive treatment.

Finally, these studies have shown that other therapeutic effects could be obtained by causing the mercury to rise and fall very rapidly and instantaneously along the limb or limbs to be treated, especially in arterial pathology and in states of muscular fatigue, after a strenuous sports activity, for example.

Known devices in the present state of the art, and particularly the device described in the patent cited earlier, do not make it possible to obtain controlled variability of the speeds (rates) of rise and/or fall of mercury within the enclosure. It should be added that they do not permit adjustment of the periods during which the mercury is maintained, in particular at the bottom level within the enclosure and at intermediate levels. Moreover, the known devices do not make it possible to control the rates of rise and/or fall of mercury between these different intermediate levels.

The precise aim of the invention is to overcome these disadvantages in order to carry out any treatment in the field of vascular, venous, lymphatic or arterial pathology by providing an apparatus which makes it possible to obtain automatically variable speeds of upward and/or downward displacement of mercury within the enclosure, to select automatically different levels of mercury within the tank as the mercury rises and/or falls, at which changes in speed of displacement can take place. The apparatus in accordance with the invention offers the further possibility of maintaining the mercury at the top and/or bottom level or at intermediate levels between these two levels during adjustable predetermined periods of time.

SUMMARY OF THE INVENTION

The invention is therefore directed to an apparatus for treating vascular, metabolic and functional imbalance and edema of a limb by variation in pressure of a high-density fluid around said limb, comprising at least one fluid-tight flexible protective bag into which the limb to be treated is introduced, at least one fluid-tight filling bag which surrounds the protective bag so as to form an interval with said protective bag, said bags being placed vertically or inclined, a filling enclosure being thus delimited by the two bags within said interval, means connected to the enclosure for producing an upward displacement of fluid within said enclosure between a bottom level ($H_o$) at a top level ($H_1$), then for producing a downward displacement of the fluid between the top level ($H_1$) and the bottom level ($H_o$), means for determining levels of fluid within the enclosure, maintaining means connected to the means for producing upward and downward displacements of fluid within the enclosure so as to maintain the fluid within the enclosure at the top level ($H_1$) and/or at the bottom level ($H_o$) and/or at intermediate levels ($H_i$) between the top and bottom levels or bottom and top levels, during respectively predetermined periods of time, means for adjusting the levels of fluid within the enclosure and connected to the level-determination means, to the means for producing upward and downward displacements of fluid and to the maintaining means in order to adjust the levels of fluid within the enclosure. Said apparatus is distinguished by the fact that it comprises in addition speed-regulating means connected to the means for producing upward and downward displacements of fluid within the enclosure and to the level-determination means in order to adjust the speed of upward and/or downward displacement of fluid between the bottom level and the top level and/or between the top level and the bottom level and/or between the intermediate levels.

DESCRIPTION OF THE PREFERRED EMBODIMENTS

Figure 1:
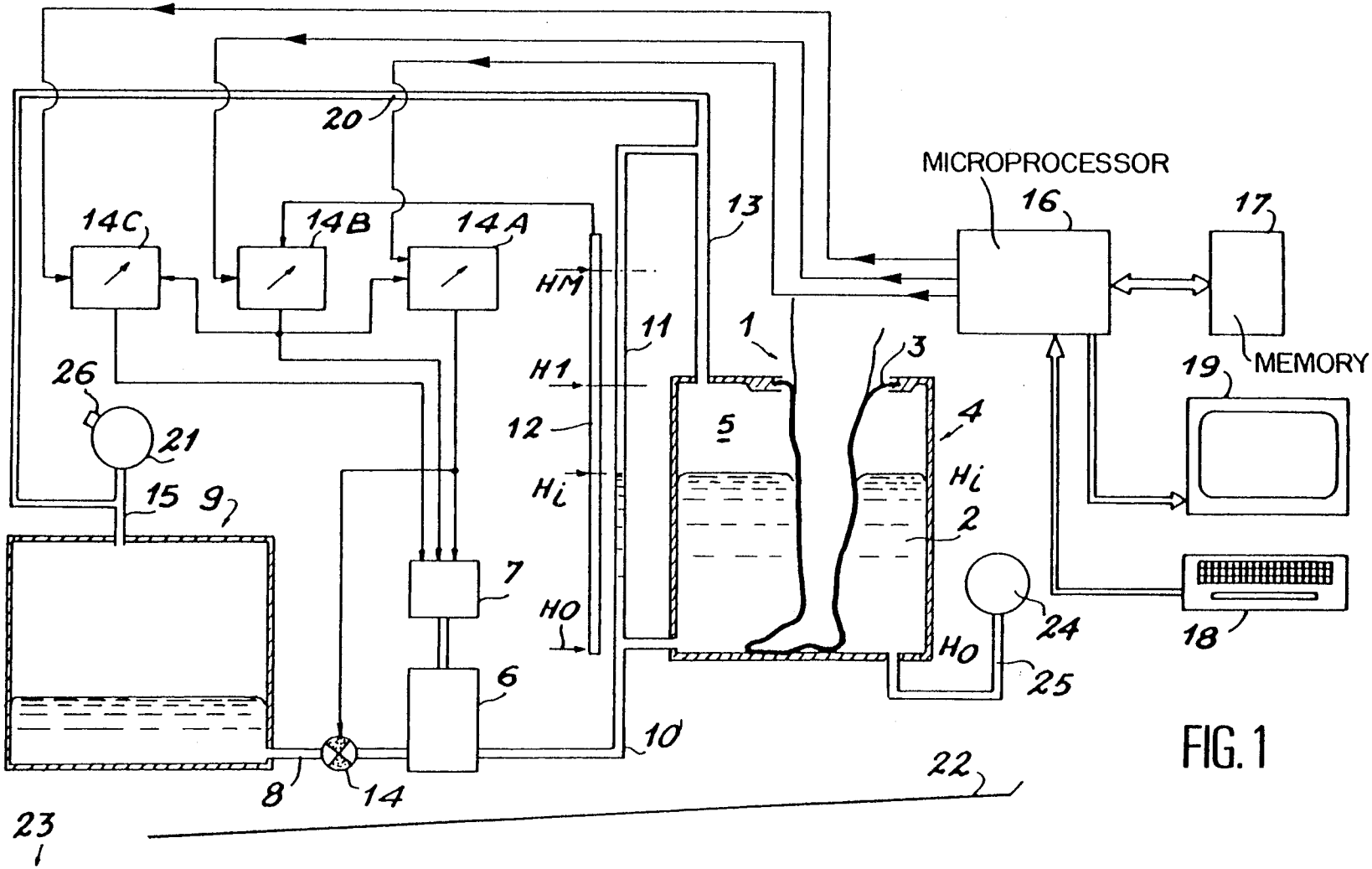
FIG. 1 illustrates diagrammatically a first embodiment of the apparatus in accordance with the invention.

FIG. 1 illustrates diagrammatically a first embodiment of the apparatus in accordance with the invention. This apparatus serves to treat a limb 1 such as a leg or an arm by varying the pressure gradient of a high-density fluid 2 (mercury, for example) around said limb. The pressure gradient can be established in a variable manner, with the result that the apparatus can be employed in the different fields of vascular, metabolic and functional pathology of the limbs, in edemas, as well as in arterial pathology.

In the embodiment shown in FIG. 1, the apparatus comprises at least one fluid-tight flexible protective bag 3 into which the limb is introduced, and at least one fluid-tight filling bag 4 which surrounds the protective bag. Said filling bag is lined or amalgamated with an unstretchable flexible textile fabric for opposing the action of Archimedean thrust.

In this embodiment, the filling bag is a rigid tank. The two bags are placed vertically or may if necessary be slightly inclined. The flexible bag 3 is attached to the top portion and to the bottom portion of the filling bag 4. The space between the flexible bag 3 and the filling bag 4 forms a filling enclosure 5 for the fluid 2. The bag 3 is attached to the top portion of the bag 4 in fluid-tight manner.

The apparatus is also provided with means for causing the fluid to rise and fall within the enclosure 5, between a bottom level $H_o$ which is the bottom of the bag 4, and a top level $H_1$, for example in the upper portion of the enclosure 5. These means, which make it possible to produce an upward or downward displacement (rise or fall) of the fluid, preferably comprise in accordance with the invention a reversible pump 6 of the gear type or of the disk type. This pump is driven in rotation by a motor 7, the direction of rotation of which can be reversed in order to cause the fluid either to rise or to fall within the enclosure 5. This pump is connected by means of a first duct 8 to a reservoir 9 which contains the high-density fluid and by means of a second duct 10 to the bottom portion of the enclosure 5.

The apparatus is also provided with means for determining the level reached by the fluid 2 within the enclosure 5 both during a rise and during a fall. These means are preferably of the optoelectronic type. They can be constituted for example by a transparent column 11 connected to the duct 10 and connected to the top portion of the enclosure 5 by means of a vertical tubular column 13. The intermediate level $H_i$ of the fluid within the enclosure is the same as that reached by said fluid within the column 11. This column is associated with a level detector 12 of the optoelectronic type which delivers on an output a signal which is characteristic of the level reached by the fluid within the column 11. This type of detector is known in the present state of the art and is not herein described in detail.

In an alternative embodiment of the apparatus in accordance with the invention, the tubular column 13 makes it possible to increase the pressure of fluid on the limb to be treated when said column is partially filled with fluid after this latter has reached the top level $H_1$ of the enclosure 5. This increase in pressure results from the well-known principle of "Pascal's pierced barrel".

The transparent column 11 as well as the level detection means 12 have a sufficient length to determine the level of fluid within the tubular column 13 up to a maximum value $H_M$.

The apparatus also comprises means 14A for maintaining the fluid within the enclosure 5 at the top level $H_1$ and/or bottom level $H_o$ or at intermediate levels $H_i$ or at upper levels (up to the level $H_M$) within the column 13, during periods which are respectively predetermined so that the means 14A can be qualified as being variable-duration fluid-maintaining means.

The fluid-maintaining means 14A are connected to the motor 7 which drives the pump 6. The fluid-maintaining levels are fixed by level-adjustment means 14B which will be described in detail hereinafter. The variable-duration fluid-maintaining means can be constituted by an adjustable timing circuit (for example monostable multivibrators associated with programmable logic circuits) which delivers control signals for stopping the motor 7 during adjustable predetermined time intervals. In fact, when the pump 6 is a gear pump or a disk pump, it is only necessary in order to maintain the fluid at a desired level within the enclosure during a predetermined period of time to stop the operation of said pump during said period when said level is reached. The fluid maintaining means 14A for adjusting the fluid-maintaining period are accordingly connected to the level-adjustment means 14B in order to receive a synchronization signal each time a fluid-maintaining level is reached.

In an alternative embodiment, the control signals delivered by the timing circuit of the means 14A can also be applied to an electrovalve 14 interposed in the first duct 8. Said electrovalve is closed during a predetermined time interval when the fluid has to be maintained within the enclosure 5 at a desired level during said time interval. In this alternative embodiment, said electrovalve is employed when the pump 6 is not a gear pump or disk pump and mere stopping of the pump does not make it possible to maintain the fluid at the desired level within the enclosure 5.

The level-adjustment means 14B are connected to the level-determination means 12 and to the motor 7 in order to deliver a control signal to said motor when a preset level is reached. Said control signal causes either stoppage of the motor 7 or a change of speed, as will hereinafter be explained in detail. Said control signal is also applied to the timing circuit of the means 14A in order to synchronize this latter and to establish the beginning of the period of maintenance of the fluid at the preset level.

There is simply a change of speed of the motor at a preset level without maintaining the fluid at this level during a predetermined period of time when said period is preset at a zero value.

The level-adjustment means can consist of a programmable logic circuit associated with a comparator which delivers a control signal when a preset level detected by the optoelectronic means 12 is reached.

In accordance with the invention, the apparatus is provided in addition with speed-regulating means 14C connected to the means 6 and 7 for producing upward and downward displacement of the fluid within the enclosure 5 and to the level-adjustment means 14B. Said means 14C make it possible to adjust the speed of upward displacement (rate of rise) of the fluid between the bottom level $H_o$ and the top level $H_1$, the speed of downward displacement (rate of fall) of the fluid between the top level $H_1$ and the bottom level $H_o$) and/or the speeds of upward and/or downward displacement between the intermediate levels $H_i$. The speed-regulating means 14C can consist of an electronic variator associated with programmable control logic circuits. Said variator receives the control signal from the level-adjustment means 14B in order to be synchronized by said means 14B when the preset level is reached. The speed is preset at a zero value if the fluid is to be maintained at a preset level by the means 14B during a predetermined period of time which is preset by the means 14A. The speed is on the contrary preset at a desired nonzero value if at a preset level the fluid is not maintained and if its rate of rise or fall has to be changed in order to assume the desired value. It will be understood that the electronic speed variator 14C also controls the direction of rotation of the motor 7 according as a rise or fall of fluid takes place within the enclosure 5.

In this embodiment, the selections of speeds, time-durations and levels are carried out by hand, by depressing keys (not shown) which permit programming of the programmable logic circuits of the adjusting means 14A, 14B, 14C.

In an alternative embodiment of the apparatus which offers even higher performance, provision is made for a microprocessor 16 connected to the fluid maintaining means 14A, to the level adjustment means 14B and to the speed regulating means 14C as well as to a memory 17 in which are recorded parameters of adjustments of time-durations, of levels and of speeds. These parameters can be supplied to the microprocessor 16 by an operator who produces action on a keyboard 18. A display screen 19 makes it possible, for example, to check the dialog between the microprocessor 16 and the operator. In this embodiment, the apparatus is fully automatic. In all the embodiments which have just been described and in all the other embodiments as well as their variants which will be described below, the enclosure 5 and the reservoir 9 are fluid-tight in order to prevent any external contamination by mercury. In order to achieve balancing of pressures in the upper portion of the mercury within the enclosure 5 and within the reservoir 9 at the time of rising and/or falling of the mercury, a pressure-balancing circuit constituted by a pipe 20 connects the top portion of the enclosure 5 (end of the tubular column 13, for example) to the top portion of the reservoir 9. This circuit can be connected to an expansion vessel 21. A closed circuit is thus established between the enclosure 5 and the reservoir 9.

In order to prevent any contamination by mercury which may escape through the pipes, the pump, or the reservoir, and in a general manner through the means for causing the mercury to rise and fall within the enclosure, means for recovering mercury can be provided beneath the apparatus as a whole. These means can consist of an inclined hopper 22 placed beneath all the elements of the apparatus which contain or convey mercury. Said hopper opens into a recovery tank 23 containing a low-density liquid such as water, for example. In the event of leakage of mercury, this latter is recovered by the hopper 22 and poured into the bottom of the recovery tank 23 in which it is covered by the water, thus avoiding any contamination.

In an alternative embodiment of the apparatus, this latter can be provided with means for bubbling mercury within the filling enclosure 5. These means can consist of a compressed-air pump 24 connected by a pipe 25 to the bottom portion of the filling enclosure 5 in order to inject air into the mercury and to cause bubbling of this latter. The compressed air can be discharged for example through a valve 26 fitted with a mercury vapor filter which opens for example into the expansion vessel 21.

In accordance with the invention and in order to ensure good operation of the pump 6 which permits upward and downward displacement of mercury within the filling enclosure 5, a lubricating fluid can be introduced into the reservoir 9 prior to startup of the apparatus.

Figure 2:
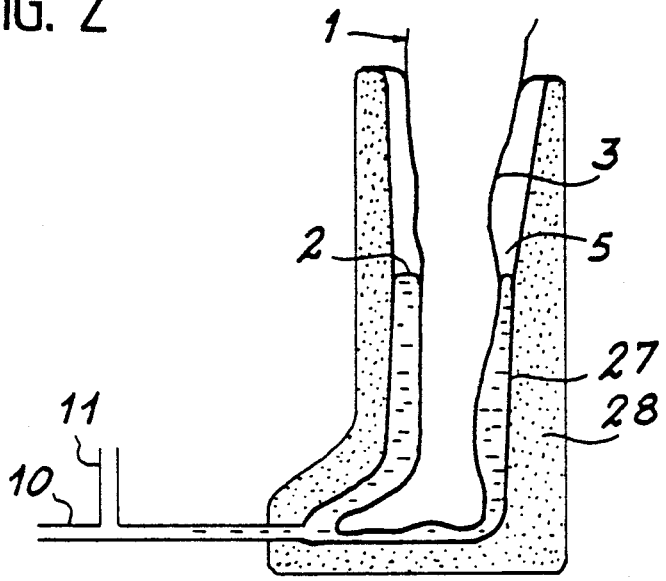
FIG. 2 illustrates diagrammatically an alternative embodiment of the apparatus in accordance with the invention.

FIG. 2 illustrates diagrammatically another alternative embodiment of the apparatus in accordance with the invention.

There are shown in this figure only those elements which are involved in this alternative embodiment. The elements already shown in FIG. 1 are designated by the same references. In this variant, the limb 1 to be treated is surrounded by the flexible protective bag 3. The protective bag 3 is surrounded by a flexible filling bag 27. In this case the filling enclosure 5 is also formed within the interval between the protective bag 3 and the filling bag 27. In this embodiment, the filling bag 27 is surrounded by a rigid, semi-rigid or flexible sheath 28 which assumes the shape of the limb to be treated. By way of example, this sheath can be formed in a non-stretch textile fabric provided with cut-out portions closed by fastening-clips, with the result that the sheath can be perfectly fitted around the filling bag when the limb to be treated has been introduced into the protective bag. The pipe 10 and the transparent tube 11 have also been shown to a partial extent in this figure. As in the embodiment of FIG. 1, the protective bag 3 can be a flexible bag containing an unstretchable structure such as mesh-work, for example.

Figure 3:
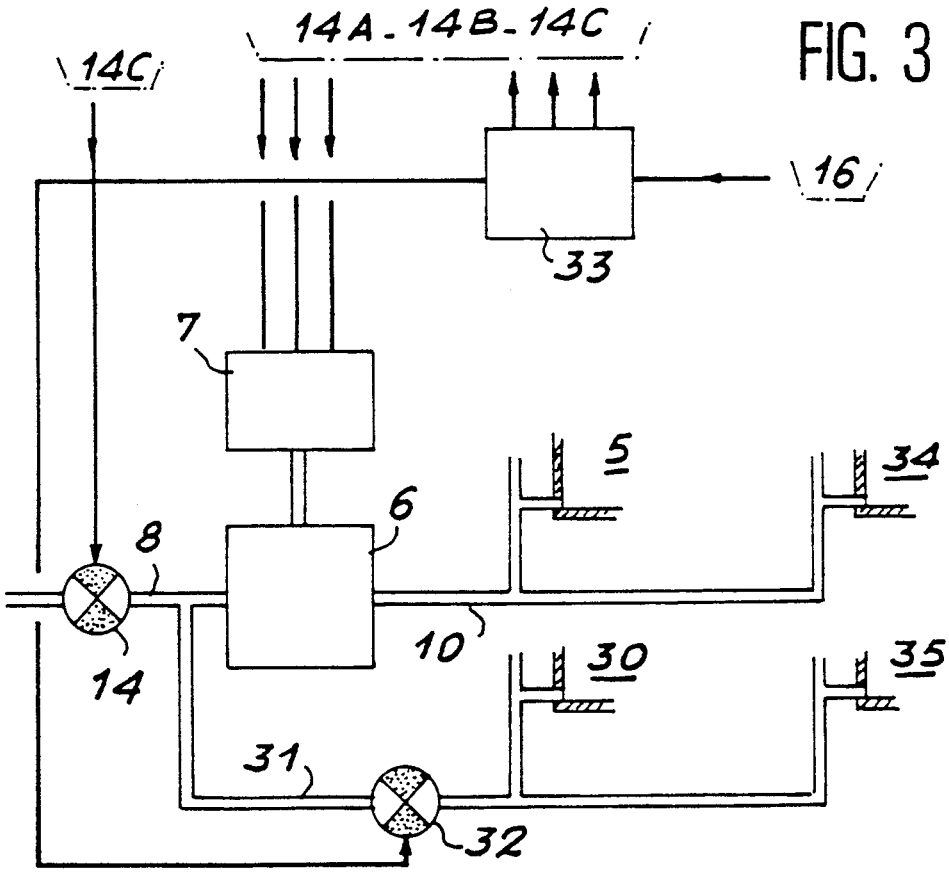
FIG. 3 illustrates diagrammatically another embodiment of the apparatus in accordance with the invention.

FIG. 3 shows diagrammatically another embodiment of the apparatus in accordance with the invention. The same elements bear the same references as in FIG. 1. Only those elements which are specific to this embodiment are illustrated in this figure. In this case the apparatus has at least a second filling enclosure 30 for treating a second limb. Said second enclosure is connected to the first duct 8 by means of a third duct 31. Said third duct is connected to the first duct between the first electrovalve 14 and the pump 6. A second electrovalve 32 is interposed in the third duct 31. The first and second electrovalves 14, 32 are connected to control means 33. By means of a signal applied to said electrovalves at the time of initial filling of the first enclosure 5 to a top level, for example, the control means aforesaid initiate opening of the first electrovalve 14 and closing of the second electrovalve 32. After this first filling operation, a signal delivered by the control means 33 initiates closing of the first electrovalve 14 and opening of the second electrovalve 32. The control means 33 are connected to the means 14A, 14B, 14C in order to deliver synchronization signals to these latter. Said control means produce action on the motor 7 of the pump 6 in order to produce an alternate sequence of upward and downward displacements of the fluid within the first and second enclosures 5, 30. As can readily be understood, the embodiment which has just been described can incorporate all the variants of the embodiment of FIG. 1.

In a variant of this second embodiment, the apparatus can comprise a third enclosure 34 connected to the pump 6 by means of the second duct 10, and a fourth enclosure 35 connected to the first duct 8 by means of the third duct 31. These two additional enclosures make it possible to treat respectively two additional limbs and therefore a number of patients.

After a first filling of the first and third enclosures 5, 34, the fluid rises within the second and fourth enclosures 30, 35 and falls within the first and third enclosures 5, 34. The contrary movement then takes place and the operation becomes alternate.

It would also be possible to interpose electrovalves respectively in the feed ducts of the enclosures 5, 30 and 34, 35, these electrovalves being connected to the control means 33, in order to limit the alternate sequence of upward and downward movements of the fluid to two coupled tanks for upper limbs or to two coupled tanks for lower limbs.

In this embodiment, the speeds of upward and downward displacements are equal. The fluid can be maintained at a top level and at a bottom level during equal predetermined time intervals.

The control means 33 are connected to the microprocessor 16 in order to receive a signal which initiates opening or closing of the electrovalves and a signal which initiates the alternate sequence of upward and downward displacements of the fluid within the enclosures.

Figure 4:
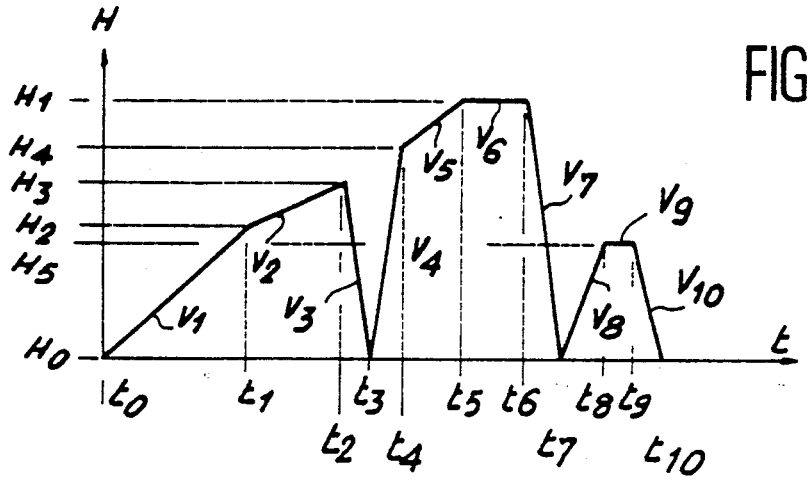
FIGS. 4, 5 and 6 are diagrams illustrating various modes of operation of the apparatus in accordance with the invention.

FIG. 4 is a diagram which serves to gain a more complete understanding of the operation and performances of the apparatus in accordance with the invention. This diagram represents one example of variations in speeds and levels H within the enclosure 5 as a function of the time t, during treatment of a limb, for example in the embodiment of FIG. 1. This diagram shows the possibilities of programming of speeds, of levels and of fluid maintenance.

At the instant $t_o$, the fluid is at the level $H_o$, which means that the enclosure 5 is empty and that the limb to be treated has just been introduced into the flexible bag 1. The diagram shows that the apparatus and more precisely the adjustment means 14A, 14B, 14C, have been programmed in order to obtain the following results:

A speed $V_1$ of upward displacement between the instants $t_o$ and $t_1$ in order that the fluid should rise from the level $H_o$ (bottom of the enclosure 5) to the intermediate level $H_2$.

A speed $V_2$ of upward displacement between the instants $t_1$ and $t_2$ in order that the fluid should rise from the intermediate level $H_2$ to the intermediate level $H_3$ without being maintained at the level $H_2$.

A speed $V_3$ of fast downward displacement between the instants $t_2$ and $t_3$ in order that the fluid should fall from the intermediate level $H_3$ to the bottom level $H_o$.

A speed $V_4$ of fast upward displacement between the instants $t_3$ and $t_4$ in order that the fluid should rise from the bottom level $H_o$ to the top level $H_4$.

A lower speed $V_5$ between the instants $t_4$ and $t_5$ in order that the fluid should pass from the intermediate level $H_4$ to the top level $H_1$.

Maintenance of the fluid (zero speed $V_6$) at the top level $H_1$, between the instants $t_5$ and $t_6$.

A speed $V_7$ of fast downward displacement between the instants $t_6$ and $t_7$ in order that the fluid should pass from the top level $H_1$ to the bottom level $H_o$.

A speed $V_8$ of upward displacement between the instants $t_7$ and $t_8$, the fluid being intended to pass from the bottom level $H_o$ to an intermediate level $H_5$.

Maintenance of the fluid at the intermediate level $H_5$ (zero speed $V_9$), between the instants $t_8$ and $t_9$.

A downward displacement of the fluid at the speed $V_{10}$, between the instants $t_9$ and $t_{10}$, the fluid being intended to pass from $H_5$ to $H_o$.

The cycle which has just been described may then be stopped or repeated in an identical or different manner, depending on the treatment which is desired.

Figure 5:
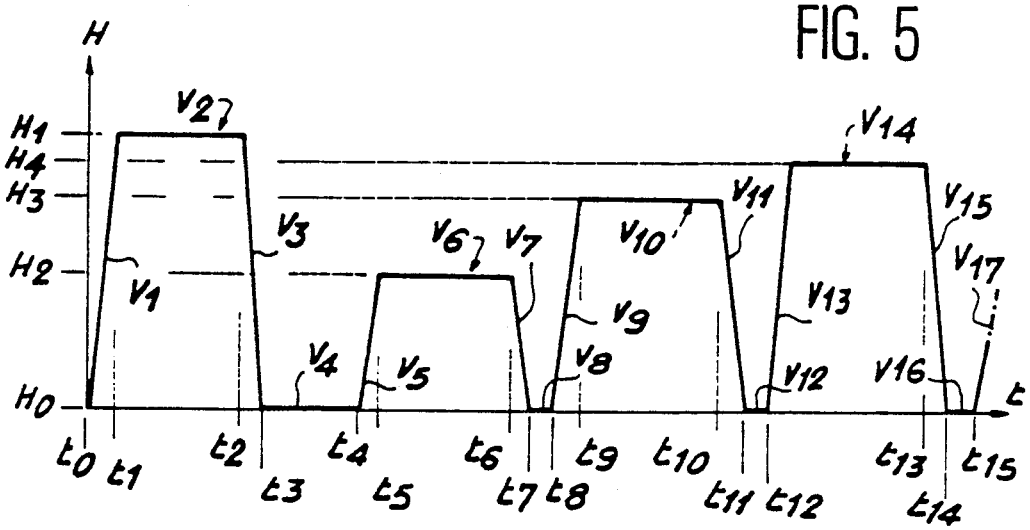

FIG. 5 is a diagram which illustrates another mode of operation of the apparatus. This diagram represents the variations in level H of the fluid within the enclosure 5 as a function of the time t. This so-called slow mode of operation is more particularly employed in venous and lymphatic pathology:

Between the instants $t_o$ and $t_1$, the speed $V_1$ of upward displacement of the fluid between the bottom level $H_o$ and the top level $H_1$ is constant.

Between $t_1$ and $t_2$, the fluid is maintained at the level $H_1$ (zero speed $V_2$).

Between $t_2$ and $t_3$, the fluid falls at a constant speed $V_3$ from the level $H_1$ to the level $H_o$ at which it is maintained until the instant $t_4$ (zero speed $V_4$).

Between $t_4$ and $t_5$, the fluid rises from the level $H_o$ to the intermediate level $H_2$ at constant speed $V_5$; it is maintained at the level $H_2$ until the instant $t_6$ (zero speed $V_6$).

Between $t_6$ and $t_7$, the fluid falls from $H_2$ to $H_o$ at a constant speed $V_7$. The fluid is maintained at $H_o$ between $t_7$ and $t_8$ at zero speed $V_8$. The cycle then continues as shown in the diagram between the instants $t_8$ and $t_{15}$ while undergoing upward displacements at constant speeds $V_9$, $V_{13}$, downward displacements at constant speeds $V_{11}$, $V_{15}$, stationary stages at zero speeds $V_{10}$, $V_{14}$ at the intermediate levels $H_3$, $H_4$, stationary stages at the bottom level $H_o$ at zero speed $V_{12}$, $V_{16}$. The cycle can then resume at the instant $t_{16}$ in an identical manner by means of an upward displacement at a speed $V_{17}$ which is equal to the speed $V_1$. By way of example, the rise or fall times are in the vicinity of one minute and the times of maintenance at the top level or at intermediate levels are in the vicinity of five minutes.

Figure 6:
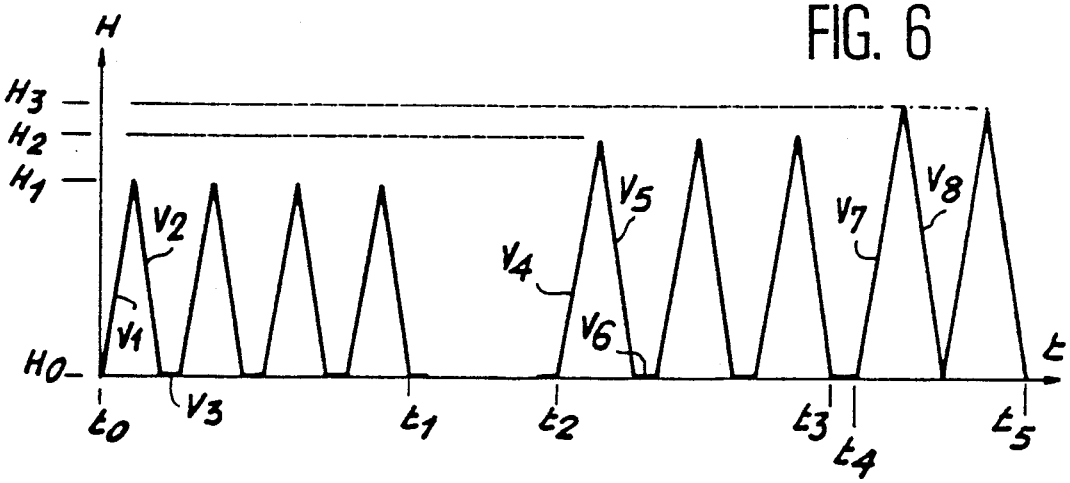

FIG. 6 is a diagram which shows another mode of operation of the apparatus. This diagram represents the variations in level H of the fluid within the enclosure 5 as a function of the time t. This so-called fast mode of operation is more particularly employed in arterial pathology and in the treatment of muscular fatigue of sportsmen and sportswomen:

Between the instants $t_o$ and $t_1$, the fluid undergoes successive upward and downward displacements (between $H_o$ and $H_1$) respectively at speeds $V_1$, $V_2$ separated by stationary stages at the bottom level $H_o$ at zero speed $V_3$. By way of example, one upward displacement and one downward displacement of the fluid take place in approximately thirty seconds whilst the time of maintenance at the bottom level is in the vicinity of thirty seconds.

Between the instants $t_2$ and $t_3$, the fluid undergoes successive upward and downward displacements (between $H_o$ and $H_2$) respectively at speeds $V_4$, $V_5$ separated by stationary stages at the bottom level $H_o$ at zero speed $V_6$. By way of example, one upward displacement and one downward displacement of the fluid take place in approximately forty-five seconds whilst the time of maintenance at the level $H_o$ remains in the vicinity of forty-five seconds.

Between the instants $t_4$ and $t_5$, the fluid undergoes successive upward and downward displacements (between $H_o$ and $H_3$) respectively at speeds $V_7$ and $V_8$ without maintenance at the bottom level $H_o$. By way of example, one upward displacement and one downward displacement of the fluid take place in approximately one minute.

The operation described between the instants $t_4$ and $t_5$ can be applied to the embodiment of FIG. 3 (a plurality of enclosures) when the speeds $V_7$ and $V_8$ are equal.

What is claimed is:

1. An apparatus for treating vascular, metabolic and functional imbalance and edema of a limb by variation in pressure of a high-density fluid around said limb, comprising at least one fluid-tight flexible protective bag into which the limb to be treated in introduced, at least one fluid-tight filling bag which surrounds the protective bag so as to form an interval with said protective bag, said bags being placed vertically or inclined, a filling enclosure being thus delimited by the two bags within said interval, displacement means connected by ducts to the enclosure for producing an upward displacement of fluid within said enclosure between a bottom level and a top level, then for producing a downward displacement of the fluid between the top level and the bottom level, level determination means for determining levels of fluid within the closure and having an output providing a level detection signal, maintaining means having an output providing a control signal connected to the displacement means for producing upward and downward displacements of fluid within the enclosure so as to maintain the fluid within the enclosure at the top level and/or at the bottom level and/or at intermediate levels between the top and bottom levels or bottom and top levels, during respectively predetermined periods of time, level adjustment means for adjusting the levels of fluid within the enclosure having an output providing a control signal, this output being connected to the displacement means and to the maintaining means and an input connected to the output of the level determination means in order to adjust the levels of fluid within the enclosure, wherein said apparatus comprises in addition speed-regulating means having an output providing a control signal and connected to the displacement means for producing upward and downward displacements of fluid within the enclosure and having an input connected to the output of the level adjustment means in order to adjust the speed of upward and/or downward displacement of fluid between the bottom level and the top level and/or between the top level and the bottom level and/or between the intermediate levels.

2. A apparatus according to claim 1, wherein the means for producing upward and downward displacements of fluid within the enclosure comprise a reversible pump connected by means of a first duct to a supply reservoir containing the high-density fluid and connected by means of a second duct to the bottom of said enclosure, said pump being driven in rotation by a motor connected to the speed-regulating means, to the fluid-maintaining means and to the level-adjustment means.

3. An apparatus according to claim 2, wherein a fluid for the lubrication of the pump is contained within said supply reservoir.

4. An apparatus according to claim 2, wherein the reversible pump is a gear pump or disk pump.

5. An apparatus according to claim 2, wherein said fluid-maintaining means comprise a variable timing circuit having an output providing a control signal and connected to said motor so as to stop the motor during said predetermined periods of time.

6. An apparatus according to claim 5, wherein said fluid-maintaining means further comprise a first electrovalve interposed in the first duct and having an input connected to said variable timing circuit in order to close the valve during said predetermined periods of time.

7. An apparatus according to claim 2, wherein said filling enclosure and said supply reservoir are fluid-tight and closed, and wherein a pipe connects a top portion of the filling enclosure to a top portion of the reservoir.

8. An apparatus according to claim 6, wherein said apparatus comprises in addition at least a second filling enclosure connected to the first duct by means of a third duct which is connected to said first duct between the first electrovalve and the pump, a second electrovalve being interposed in the third duct, and control means having output; t providing control signals, these output being connected to the first and second electrovalves in order to initiate opening of the first electrovalve and closing of the second electrovalve at the time of a first filling of the first enclosure, then in order to initiate closing of the first electrovalve and opening of the second electrovalve after said first filling operation, the output of the means for adjusting speeds, levels and for maintaining fluid being connected to said control means with a view to subsequently producing an alternate sequence of upward and downward displacements of the fluid within the first and second enclosures.

9. An apparatus according to claim 1, wherein input of fluid-maintaining means, level-adjusting means, speed-regulating means, are connected to output of a microprocessor which is in turn connected to output of a memory recording the value of speeds, time-durations and levels.

10. An apparatus according to claim 2, wherein said filling bag is a flexible bag surrounded by which assumes the shape of the limb to be treated.

11. An apparatus according to claim 2, wherein said filling bag is a flexible bag having an unstretchable structure.

* * * * *